United States Patent [19]

Taber

[11] Patent Number: 4,980,267

[45] Date of Patent: Dec. 25, 1990

[54] PHOTOGRAPHIC ELEMENT AND PROCESS COMPRISING A DEVELOPMENT INHIBITOR RELEASING COUPLER AND A YELLOW DYE-FORMING COUPLER

[75] Inventor: Terry R. Taber, Rochester, N.Y.

[73] Assignee: Eastman Kodak Company, Rochester, N.Y.

[21] Appl. No.: 238,369

[22] Filed: Aug. 30, 1988

[51] Int. Cl.[5] ..... G03C 7/36

[52] U.S. Cl. ..... 430/382; 430/505; 430/544; 430/557; 430/549

[58] Field of Search ..... 430/544, 557, 549, 382, 430/505

[56] References Cited

U.S. PATENT DOCUMENTS

| | | | |
|---|---|---|---|
| 3,227,554 | 1/1966 | Barr et al. | 430/382 |
| 4,022,620 | 5/1977 | Okumura et al. | 430/557 |
| 4,248,962 | 2/1981 | Lau | 430/382 |
| 4,269,936 | 5/1981 | Arai et al. | 430/557 |
| 4,409,323 | 10/1983 | Sato et al. | 430/544 |
| 4,434,226 | 2/1984 | Wilgus et al. | 430/567 |
| 4,476,219 | 10/1984 | Sakanoue et al. | 430/542 |
| 4,490,459 | 12/1984 | Iijima et al. | 430/544 |
| 4,524,130 | 6/1985 | Iwasa et al. | 430/505 |
| 4,690,888 | 9/1987 | Fujiwhara et al. | 430/549 |
| 4,782,012 | 11/1988 | DeSelms et al. | 430/544 |
| 4,783,397 | 11/1988 | Ogawa et al. | 430/557 |

FOREIGN PATENT DOCUMENTS

| | | |
|---|---|---|
| 0096873 | 2/1987 | European Pat. Off. . |
| 0228561 | 7/1987 | European Pat. Off. . |
| 0271324 | 6/1988 | European Pat. Off. . |
| 59-060437 | 4/1984 | Japan . |
| 2099167 | 12/1982 | United Kingdom . |

OTHER PUBLICATIONS

British Journal of Photography, Photographic Annual of 1982, pp. 209–211.

Research Disclosure, Dec. 1978, Item No. 17643, vol. 176; Kenneth Mason Publications Ltd., Hampshire, England.

*Primary Examiner*—Richard L. Schilling

*Attorney, Agent, or Firm*—Richard E. Knapp

[57] ABSTRACT

A combination of a development inhibitor releasing coupler having a particular releasable mercaptotetrazole group with a particular alkoxy-benzoyl yellow dye-forming coupler as described in the specification in a photographic silver halide element and process enables improved dye images upon exposure and processing. This combination of couplers enables particularly improved dye images in a color photographic element and process comprising a particular phenolic cyan dye-forming coupler and a particular pyrazolo[3,2-c]-s-triazole magenta dye-forming coupler.

12 Claims, No Drawings

PHOTOGRAPHIC ELEMENT AND PROCESS COMPRISING A DEVELOPMENT INHIBITOR RELEASING COUPLER AND A YELLOW DYE-FORMING COUPLER

This invention relates to a photographic element and process comprising a particular development inhibitor releasing coupler and a particular yellow dye-forming coupler.

Images are commonly obtained in the photographic art by a coupling reaction between the development product of a silver halide color developing agent, particularly an oxidized aromatic primary amino developing agent, and a color forming compound commonly described as a coupler. The dyes formed depend upon the composition of the chemical composition of the coupler and the developing agent. The subtractive process is commonly employed in multicolor photographic elements and the resulting image dyes are typically cyan, magenta and yellow dyes that are formed in or adjacent to silver halide layers sensitive to the radiation complementary to the radiation absorbed by the image dye.

One of the ways recognized in the photographic art for improving the quality of such dye images formed in color photographic silver halide elements includes improvement of graininess, sharpness and color tonal rendition of such images by the use of compounds capable of providing a diffusible development inhibitor moiety as a function of silver halide development. These compounds are typically described in the patent and technical literature as development inhibitor releasing compounds or couplers (DIR compounds and DIR couplers). Such representative DIR compounds and DIR couplers are described in, for example, U.S. Pat. Nos. 3,227,554; 3,701,783; 3,615,506; 3,617,291; 3,379,529; 3,620,746; 3,384,657; 3,733,201; 4,248,962; and 4,409,323. Within these DIR couplers is a class of coupler that enables release of the development inhibitor moiety by means of an anchimeric release mechanism. This class of DIR couplers is typically described as DIAR couplers and includes those described in, for example, U.S. Pat. No. 4,248,962.

One class of DIR compounds and couplers is described in U.K. Patent Specification No. 2,099,167 that involves design of the development inhibitor molecule to enable the inhibitor moiety to form a species that is inactive as a development inhibitor in the processing solution after the inhibitor moiety is diffused from the element into such a solution. Such couplers described in U.K. Patent Specification No. 2,099,167 include, for example, DIAR couplers. While many of such DIR compounds and couplers, including DIAR couplers, are effective for such purposes, the combination of such DIR couplers with known yellow dye forming couplers does not provide the desired combination of the desired degree of interimage effect with the desired rate of reaction matching the rate of reaction of the image dye-forming coupler. This problem is demonstrated by the lack of desired yellow image and interimage effect provided by a combination of an illustrative DIR coupler from U.K. Patent Specification No. 2,099,167 represented by the formula:

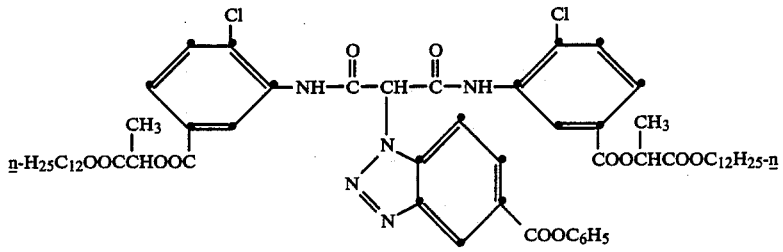

(DIR-A)

used in a typical photographic silver halide element with an illustrative typical yellow dye-forming coupler represented by the formula:

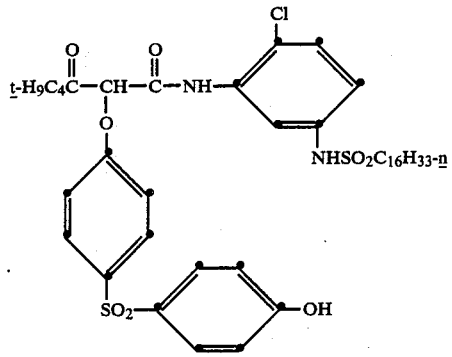

(Y-A)

described in, for example, U.S. Pat. No. 3,933,501. This yellow dye-forming coupler is illustrative of those yellow dye-forming couplers having a phenoxy coupling-off group. This illustrative combination of yellow dye-forming coupler and the described DIR coupler does not provide the desired match in reactivity and desired interimage effect. This is demonstrated in the following comparative examples.

Another class of yellow dye-forming couplers is illustrated by those described in, for example, U.S. Pat. No. 4,022,620 having a coupling-off group. Such couplers are illustrated in the yellow dye-forming coupler of the formula:

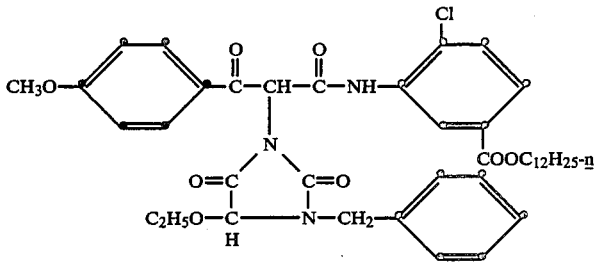

(Y-B)

This known yellow dye-forming coupler also does not provide the combination of desired interimage effect and desired matching of reactivity when used in combination with a known DIR coupler, such as the described illustrative DIR coupler from U.K. Patent Specification No. 2,099,167. This is also illustrated in the following comparative examples.

Accordingly, a continuing need has existed to provide a combination of a DIAR coupler that enables release of a mercapto development inhibitor that is converted to an inactive species in the photographic processing solution and a yellow dye-forming coupler that enables formation of a dye of desired hue and wherein the combination of couplers has desired matched reactivity rates and enables desired interimage effects. A continuing need has also existed to provide such a combination with a particular cyan dye-forming coupler and a particular magenta dye-forming coupler with DIR couplers for these couplers that enables an improved full color image in a photographic silver halide element and process.

It has been found that the described advantages can be provided by a photographic element comprising a support bearing at least one photographic silver halide emulsion layer, at least one photographic development inhibitor releasing coupler, herein described as DIAR coupler I, represented by the formula:

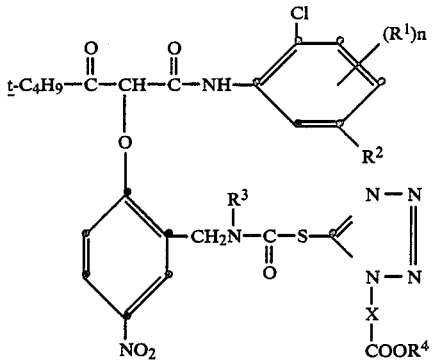

DIAR I wherein $R^1$ is a substituent that does not adversely affect the development inhibitor releasing properties of the coupler, such as an unsubstituted or substituted alkyl group;

n is 0, 1 or 2;

$R^2$ is a ballast group;

$R^3$ is unsubstituted or substituted alkyl, such as methyl, ethyl, propyl, t-butyl or n-butyl; or unsubstituted or substituted aryl, such as phenyl;

$R^4$ is alkyl containing 2 to 5 carbon atoms, such ethyl, propyl, butyl and pentyl; and X is alkylene containing 1 to 3 carbon atoms, such as methylene (—$CH_2$—), ethylene (—$CH_2$—$CH_2$—) and propylene (—$CH_2$—$CH_2$—$CH_2$—); and, at least one yellow dye-forming coupler represented by the formula:

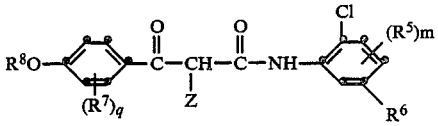

(Y-I)

wherein $R^5$ and $R^7$ are individually substituted or unsubstituted alkyl, such as methyl, ethyl, propyl or butyl, or substituted or unsubstituted aryl, such as phenyl, or benzyl; or alkoxy, such as alkoxy containing 1 to 30 carbon atoms, for example, methoxy, ethoxy, butoxy, propoxy and decyloxy;

m and q are individually 0, 1 or 2;

$R^6$ is a ballast group;

$R^8$ is unsubstituted or substituted alkyl, such as methyl, ethyl, propyl, butyl, hexyl and octyl;

Z is a coupling-off group that is

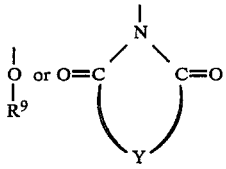

wherein $R^9$ is unsubstituted or substituted aryl, such as phenyl; and,

Y represents the atoms necessary to complete an unsubstituted or substituted five member heterocyclic ring, such as the atoms

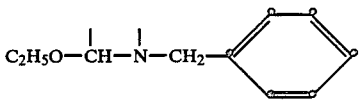

or

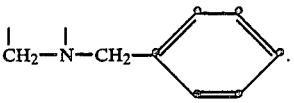

The described photographic element preferably comprises a support bearing at least one red-sensitive silver halide emulsion layer comprising a phenolic cyan dye-forming coupler having in the 5-position a ballast group comprising a sulfone group and in the 2-position a para-cyanophenylureido group; at least one green-sensitive silver halide emulsion layer comprising a pyrazolo[3,2-c]-s-triazole magenta dye-forming coupler comprising an alkyl group containing 1 to 4 carbon atoms in the 6-position, a ballast group in the 3-position, particularly one having a terminal carboxy group, and a coupling-off group in the 7-position; and at least one blue-sensitive silver halide emulsion layer comprising a yellow dye-forming coupler as described above and in at least one of the layers of the photographic element a photographic development inhibitor releasing coupler represented by the formula DIAR I as described above.

Combinations of DIAR couplers within the formula DIAR I can be used if desired. Also, combinations of yellow dye-forming couplers within the formula Y-I can be used if desired.

The described DIAR coupler I contains a coupling-off group that enables desired control over the time of release of the development inhibitor moiety and the rate of release of the development inhibitor moiety. The coupling-off group structure between the coupling position and the sulfur atom of the development inhibitor moiety functions as a timing group for release of the development inhibitor moiety. The reaction of the DIAR coupler I with oxidized color developing agent cleaves the bond between the timing group and the coupling moiety. Then an intramolecular nucleophilic displacement reaction cleaves the bond between the development inhibitor moiety and the timing group. This sequence of reactions takes place at the appropriate time during processing to enable the yellow dye image to form from the described yellow dye-forming coupler and enable desired interimage effects.

As used herein the term "coupler" refers to the entire compound including the coupler moiety and the coupling-off group. The term coupler moiety refers to that portion of the compound other than the coupling-off group.

A preferred development inhibitor releasing coupler is represented by the formula:

DIAR II

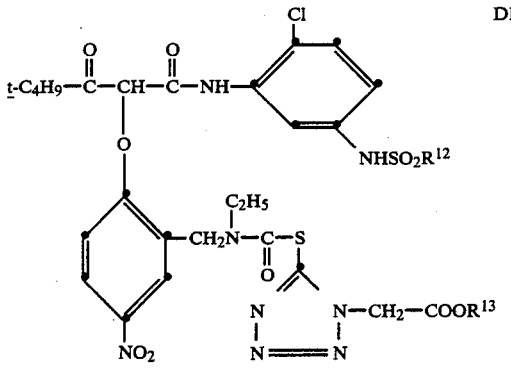

wherein $R^{12}$ is alkyl containing 8 to 32 carbon atoms; and $R^{13}$ is alkyl containing 2 to 5 carbon atoms.

Examples of preferred DIAR couplers are:

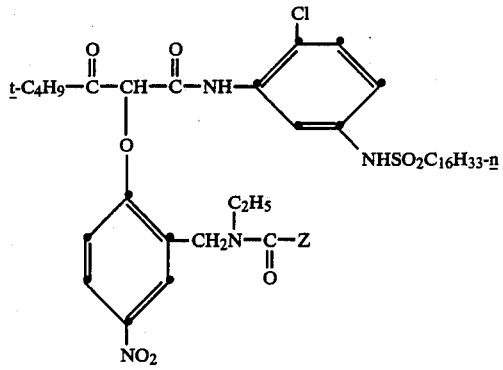

Z in the above formula is as follows:

1.
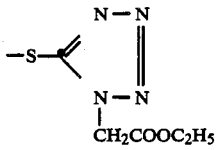

2.
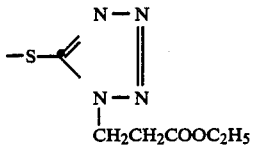

3.
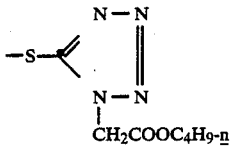

4.
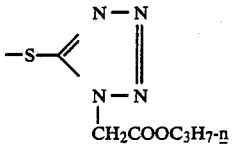

5.
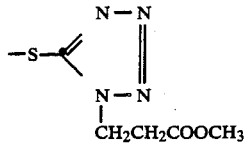

A ballast group as described herein is an organic radical of such size and configuration as to confer on the coupler molecule sufficient bulk to render the coupler substantially non-diffusible from the layer in which it is coated in the described photographic element. Coupler moieties as described can be attached to ballast groups, or to polymeric chains through one of the groups on the anilide portion of the coupler moiety. Representative ballast groups include substituted or unsubstituted alkyl or aryl groups containing 8 to 40 carbon atoms; sulfonamido groups containing 8 to 40 carbon atoms (—NH-$SO_2R$); sulfamyl groups containing 8 to 40 carbon atoms (—$SO_2NHR$); carbonamido groups containing 8 to 40 carbon atoms (—NHCOR); carbamoyl groups containing 8 to 40 carbon atoms (—NHCOOR); ester groups containing 8 to 40 carbon atoms (—COOR); alkoxy groups containing 8 to 40 carbon atoms; aryloxy groups. Representative substituents on such groups include alkyl, aryl, alkoxy, aryloxy, alkylthio, hydroxy, halogen, alkoxycarbonyl, aryloxycarbonyl, carboxy, acyl, acyloxy, amino, anilino, carbonamido, carbamoyl, alkylsulfonyl, arylsulfonyl, sulfonamido, and sulfamyl groups wherein the substituents typically contain 1 to 40 carbon atoms, such as 8 to 32 carbon atoms. Such substituents can also be further substituted with such groups.

The described yellow dye-forming coupler enables formation of a yellow dye image that has particularly high dye extinction. A preferred yellow dye-forming coupler within the described formula is represented by the formula:

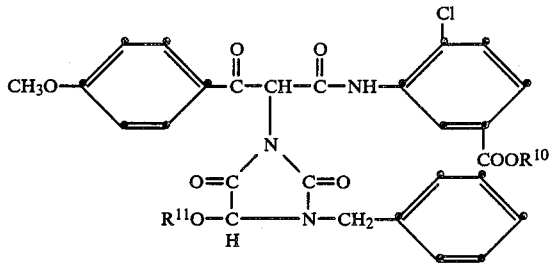

wherein $R^{10}$ is alkyl containing 8 to 32 carbon atoms; and, $R^{11}$ is alkyl containing 2 to 4 carbon atoms.

Examples of preferred yellow dye-forming couplers are:

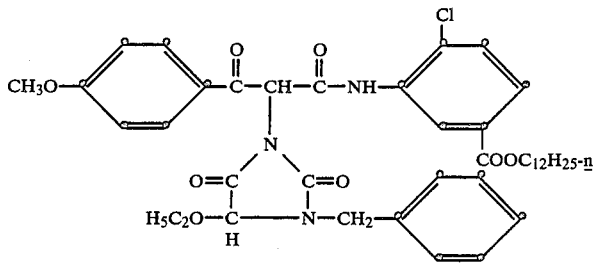

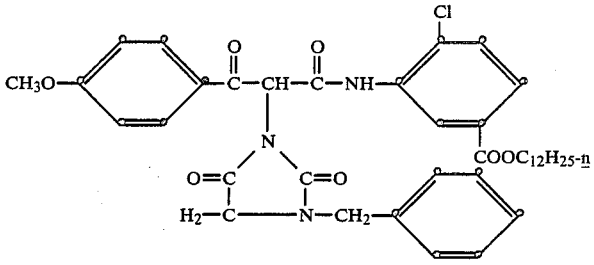

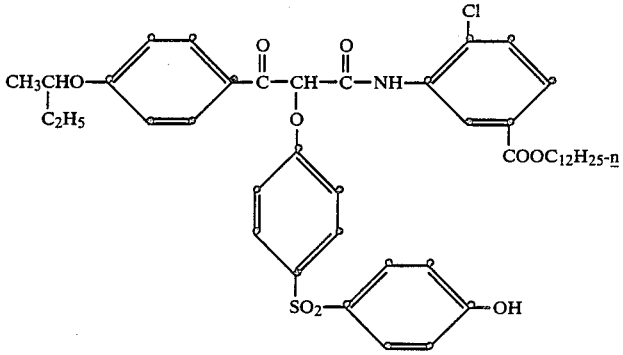

-continued

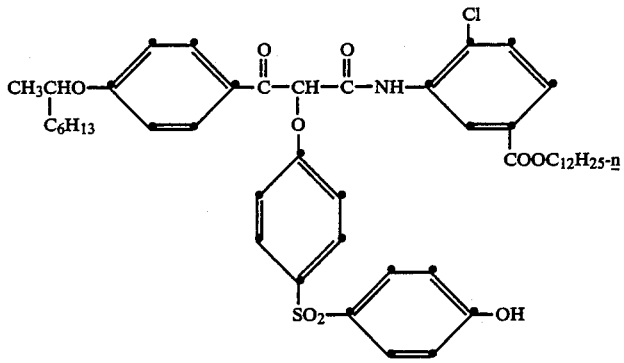

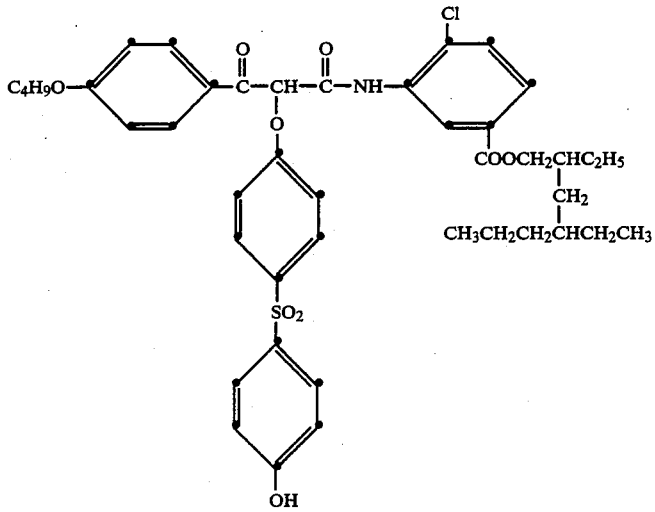

The described DIAR coupler I and the described yellow dye-forming coupler can be used in a photographic silver halide element comprising at least one layer sensitive to the blue region of the spectrum. The described element can also contain a layer or layers sensitive to other regions of the spectrum. For example, the photographic element can contain at least one red-sensitive silver halide emulsion layer containing at least one cyan dye-forming coupler. Such cyan dye-forming couplers are preferably phenols or naphthols. Representative cyan dye-forming couplers are described in, for example, the following patents and publications: U.S. Pat. Nos. 2,772,162; 2,895,826; 3,002,836; 3,034,892; 2,474,293; 2,423,730; 2,367,531; 3,041,236 and 4,333,999 and "Farbkuppler-eine Literaturubersicht", published in Agfa Mitteilungen Band III, pp. 156–175 (1961). Preferred cyan dye-forming couplers are those described in, for example, copending U.S. patent application Ser. No. 940,829 of Hoke and Kilminster, filed Dec. 12, 1986 now U.S. Pat. No. 4,775,616, the disclosure of which is expressly incorporated herein by reference. Preferred examples of such cyan dye-forming couplers are:

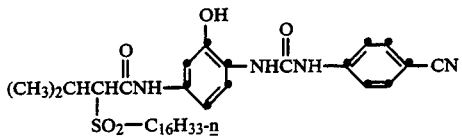

The described photographic element can also contain a layer or layers that are sensitive to the green region of the spectrum and contain at least one magenta dye-forming coupler. Preferred couplers that form magenta dyes upon reaction with oxidized color developing agent are pyrazolones, pyrazolotriazoles, pyrazolobenzimidazoles and indazolones. Representative couplers that form magenta dyes are described in, for example: U.S. Pat. Nos. 2,600,788; 2,369,489; 2,343,703; 2,311,082; 2,673,801; 3,152,896; 3,519,429; 3,061,432; 3,062,653; 3,725,067; and 2,908,573 and "Farbkuppler-eine Literaturubersicht", published in Agfa Mitteilungen, Band III, pages 126–156 (1961). A preferred magenta dye-forming coupler is a pyrazolo[3,2-c]-s-triazole, such as described in copending U.S. Patent applications Ser. No. 23,518 of Romanet et al, filed Mar. 9, 1987 and Ser. No. 23,519 of Bowne et al, filed Mar. 9, 1987, the disclosures of which are expressly incorporated herein by reference. Examples of such preferred magenta dye-forming couplers are:

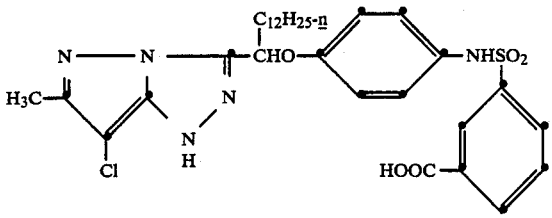

or

-continued

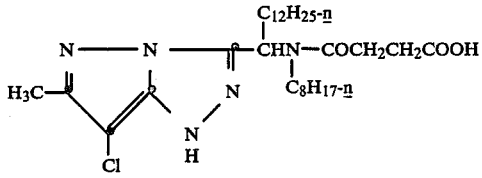

While it is highly preferred to use the described yellow dye-forming couplers as the only yellow image dye-forming coupler in the described blue-sensitive silver halide emulsion layer, it is possible to use other yellow dye-forming couplers in combination with the described yellow dye-forming couplers. Such other yellow dye-forming couplers are preferably acylacetanilides such as benzolylacetanilides. Examples of such other yellow dye-forming couplers are:

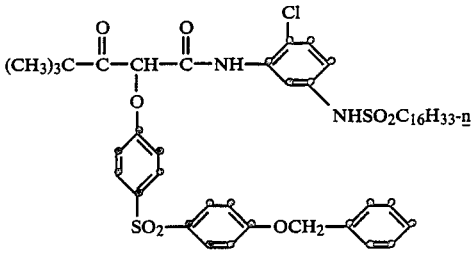

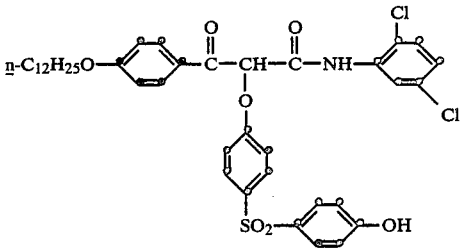

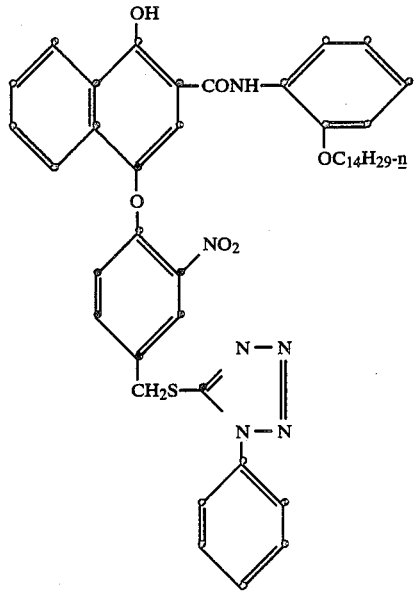

or

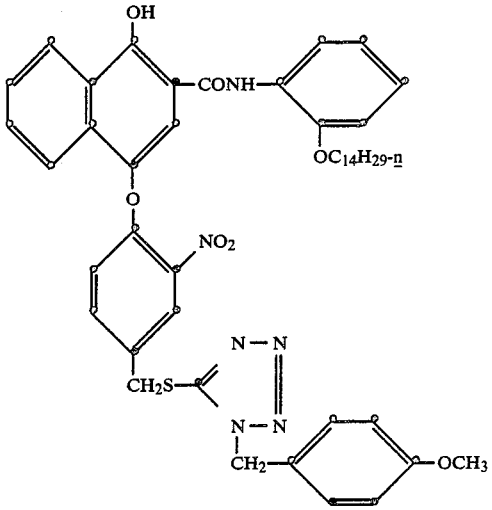

The described red-sensitive layer or layers and green-sensitive layer or layers can comprise DIR compounds or couplers, particularly DIAR compounds or DIAR couplers, that enable desired interimage effects for these layers. For example, these layers can comprise DIAR couplers that are within those described in U.S. Pat. No. 4,248,962 and development inhibitor releasing couplers within U.S. Pat. No. 4,409,323. A preferred DIAR coupler in the green-sensitive layer and/or in a layer that is contiguous to the green-sensitive layer is a DIAR coupler as described that is within copending U.S. patent application Ser. No. 074,582 of DeSelms and Kapecki, filed Jul. 17, 1987 now U.S. Pat. No. 4,782,012. A preferred development inhibitor releasing coupler in the red-sensitive layer is The latter development inhibitor releasing coupler is within copending U.S. Pat. application Ser. No. 209,741, of Szajewski, Poslusny and Slusarek, filed Jun. 21, 1988, the disclosure of which is incorporated herein by reference.

The compounds employed in this invention can be prepared by synthetic procedures known in the art. In the case of the DIAR coupler I, the synthesis involves first attaching the timing group to the appropriate coupler moiety followed by the attachment of the appropriate derivative of the inhibitor group to form the desired DIAR coupler. Optionally, the timing group can be attached to the coupler moiety after first combining the timing group and the inhibitor moiety by an appropriate reaction. The inhibitor moiety can be synthesized according to the scheme shown in J. Heterocyclic Chem., 15, 981 (1978).

The described yellow dye-forming coupler can also be prepared by synthetic procedures known in the art, such as described in U.S. Pat. No. 4,022,620.

The described couplers can be used and incorporated in photographic elements in the way that couplers have been used and incorporated in photographic elements in the photographic art. The described photographic element is preferably a multicolor element. Multicolor elements preferably contain dye image-forming units sensitive to each of the three primary regions of the visible spectrum. Each unit can be comprised of a single emulsion layer or of multiple emulsion layers sensitive to a given region of the spectrum.

The couplers of this invention can be incorporated in silver halide emulsions and the emulsions can be coated on a support to form a photographic element. Alternatively, at least one of the couplers can be incorporated in photographic elements adjacent the silver halide emulsion where, during development, the coupler will be in reactive association with development products such as oxidized color developing agent.

The photographic elements can be either single color or multicolor elements. In a multicolor element, the yellow dye-forming coupler and the DIAR coupler I are usually associated with a blue-sensitive emulsion, although they could be associated with an unsensitized emulsion or an emulsion sensitized to a different region of the spectrum. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler, a magenta image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

In the following discussion of suitable materials for use in the elements of this invention, reference will be made to *Research Disclosure*, December 1978, Item 17643, published by Kenneth Mason Publications, Ltd., The Old Harbourmaster's, 8 North Street, Emsworth, Hampshire PO10 7DD, ENGLAND, the disclosures of which are incorporated herein by reference. This publication will be identified hereafter by the term "*Research Disclosure.*"

The silver halide emulsions employed in the elements of this invention can be comprised of silver bromide, silver chloride, silver iodide, silver chlorobromide, silver chloroiodide, silver bromoiodide, silver chlorobromoiodide or mixtures thereof. The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al U.S. Pat. No. 4,434,226, Daubendiek et al U.S. Pat. No. 4,414,310, Wey U.S. Pat. No. 4,399,215, Solberg et al U.S. Pat. No. 4,433,048, Mignot U.S. Pat. No. 4,386,156, Evans et al U.S. Pat. No. 4,504,570, Maskasky U.S. Pat. No. 4,400,463, Wey et al U.S. Pat. No. 4,414,306, Maskasky U.S. Pat. Nos. 4,435,501 and 4,643,966 and Daubendiek et al U.S. Pat. Nos. 4,672,027 and 4,693,964. Also specifically contemplated are those silver bromoiodide grains with a higher molar proportion of iodide in the core of the grain than in the periphery of the grain, such as those described in GB No. 1,027,146; JA No. 54/48,521; U.S. Pat. Nos. 4,379,837; 4,444,877; 4,665,012; 4,686,178; 4,565,778; 4,728,602; 4,668,614; 4,636,461; EP No. 264,954. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion.

The emulsions can be surface-sensitive emulsions, i.e., emulsions that form latent images primarily on the surfaces of the silver halide grains, or internal latent image-forming emulsions, i.e., emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized. Noble metal (e.g., gold), middle chalcogen (e.g., sulfur, selenium, or tellurium), and reduction sensitizers, employed individually or in combination, are specifically contemplated. Typical chemical sensitizers are listed in *Research Disclosure*, Item 17643, cited above, Section III.

The silver halide emulsions can be spectrally sensitized with dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, styryls, merostyryls, and streptocyanines. Illustrative spectral sensitizing dyes are disclosed in *Research Disclosure*, Item 17643, cited above, Section IV.

Suitable vehicles for the emulsion layers and other layers of elements of this invention are described in Research Disclosure Item 17643, Section IX and the publications cited therein.

In addition to the couplers described herein the elements of this invention can include additional couplers as described in Research Disclosure Section VII, paragraphs D, E, F and G and the publications cited therein. These additional couplers can be incorporated as described in Research Disclosure Section VII, paragraph C and the publications cited therein.

The photographic elements of this invention can contain brighteners (Research Disclosure Section V), antifoggants and stabilizers (Research Disclosure Section VI), antistain agents and image dye stabilizers (Research Disclosure Section VII, paragraphs I and J), light absorbing and scattering materials (Research Disclosure Section VIII), hardeners (Research Disclosure Section X), coating aids (Research Disclosure Section XI), plasticizers and lubricants (Research Disclosure Section XII), antistatic agents (Research Disclosure Section XIII), matting agents (Research Disclosure Section XVI) and development modifiers (Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylene diamines. Especially preferred are 4-amino-3-methyl-N,N-diethylaniline hydrochloride, 4-amino-3-methyl-N-ethyl-N-β-(methanesulfonamido)ethylaniline sulfate hydrate, 4-amino-3-methyl-N-ethyl-N-β-hydroxyethylaniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

With negative-working silver halide, the processing step described above provides a negative image. The described elements are preferably processed in the known C-41 color process as described in, for example, the British Journal of Photography Annual of 1982, pages 209–211. To provide a positive (or reversal) image, the color development step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver or silver halide, washing, and drying.

The following examples are included for a further understanding of the invention.

EXAMPLE 1

On a cellulose triacetate film support were coated the following layers: (coverages are in grams per meter squared).

First Layer

A magenta dye-forming layer comprising a green-sensitized, polydisperse silver bromoiodide emulsion (12 mole percent iodide) (average grain size: 0.065 millimicron) (1.08). A magenta dye-forming coupler of the following structure was incorporated in this layer (0.86):

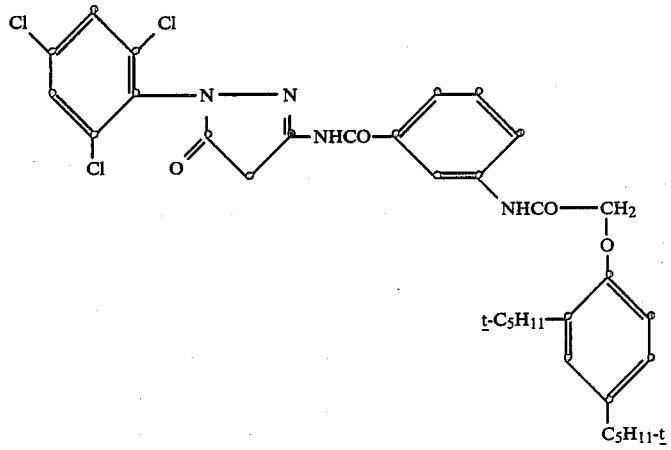

This layer also contained gelatin (1.6).

Second Layer

An interlayer was coated on the first layer comprising a yellow filter dye (0.11), an oxidized developer scavenger (0.11) and gelatin (2.15).

Third Layer

A yellow dye-forming layer was coated on the second layer comprising a blend of three blue-sensitive, tabular grain silver bromoiodide emulsions (3 mole percent iodide) (0.81 of total blend) and gelatin (2.15). The blend comprised (A) blue-sensitized, tabular grain silver bromoiodide emulsion (3 mole percent iodide) (grain size: 1.0 millimicron in diameter and 0.10 millimicron thick); (B) blue-sensitized, tabular grain silver bromoiodide emulsion (3 mole percent iodide) (grain size: 0.4 millimicron in diameter and 0.08 millimicron thick); and, (C) blue-sensitized, tabular grain silver bromoiodide emulsion (3 mole percent iodide) (grain size: 2.0 millimicron in diameter and 0.11 millimicron thick).

The third layer (yellow dye-forming layer) also contained a yellow image-forming coupler and a development inhibitor releasing coupler as designated in following Table I. An overcoat layer was then applied to the third layer. The overcoat comprised gelatin (2.69).

The photographic elements were imagewise exposed for one-tenth of a second through a graduated step wedge to a light source at 5500° K. and a 2B Wratten filter (Wratten is a trademark of Eastman Kodak Co., U.S.A.). The exposed elements were processed in a standard C-41 process as described in the British Journal of Photography Annual, 1977, pages 201–205.

Interimage effects were evaluated in the processed elements. Interimage effect in the described bilayer format herein means the ratio of the gamma of the blue-sensitive layer to the gamma of the green-sensitive layer. The preferred interimage effect is represented by maximizing this ratio while adequately inhibiting the green-sensitive layer.

The preferred combination according to the data in the Table is the combination of couplers Y-Z and DIAR-Z.

TABLE I

| Yellow Image Coupler ($g/m^2$) Concentration | Yellow DIR Coupler ($g/m^2$) Concentration | Blue Gamma | Green Gamma | Blue/Green Gamma Ratio |
|---|---|---|---|---|
| Y-X (1.18) (Comparison) | DIR-X (0.22) | 1.01 | 0.87 | 1.16 |
| Y-X (1.18) (Comparison) | DIAR-Z (0.25) | 0.88 | 0.73 | 1.22 |
| Y-Z (1.10) (Comparison) | DIR-X (0.22) | 0.94 | 0.61 | 1.54 |
| Y-Z (1.10) (Invention) | DIAR-Z (0.25) | 1.04 | 0.60 | 1.73 |

EXAMPLE 2

(Three Color Photographic Format)

A cellulose triacetate film support having an antihalation layer was coated with the following layers, in sequence (coverages are in grams per meter squared):

Slow Cyan Dye-forming Layer

This layer comprised a blend of (A) red-sensitized, cubic, silver bromoiodide emulsion (3 mole percent iodide) (0.2 millimicron grain size) (0.32) and (B) red-sensitized, tabular grain, silver bromoiodide emulsion (3 mole percent iodide) (0.51 millimicron diameter by 0.11 millimicron thick) (1.29). A cyan dye-forming coupler C-X was incorporated in this layer (0.97). A DIAR coupler designated as DIAR-C was also incorporated in this layer (0.05). Gelatin was also included (2.52).

Fast Cyan Dye-forming Layer

This layer comprised a red-sensitized, tabular grain silver bromoiodide emulsion (3 mole percent iodide) having a diameter of 1.10 millimicron and a thickness of 0.12 millimicron (0.81). The layer also comprised a cyan image dye-forming coupler that was coupler C-X (0.32). A DIAR coupler was incorporated in the layer that was DIAR-C (0.04). A colored coupler designated as C-X1 (0.04) and gelatin (1.29) were also incorporated in the layer.

Interlayer

This layer comprised an oxidized developer scavenger (0.05) and gelatin (1.29).

Slow Magenta Dye-forming Layer

This layer comprised a blend of (A) green-sensitized, 0.2 millimicron, cubic silver bromoiodide emulsion (0.27) and (B) green-sensitized, tabular grain silver bromoiodide emulsion (3 mole percent iodide) (grain diameter of 0.51 millimicron and a thickness of 0.11 millimicron) (1.08). A magenta dye-forming coupler designated as M-X (0.61) was incorporated in the layer. A colored coupler designated as M-X1 (0.08) and a DIR coupler designated as DIR-M (0.008) were also added with gelatin (1.61).

Fast Magenta Dye-forming Layer

This layer comprised a green-sensitized, tabular grain silver bromoiodide (3 mole percent iodide) (grain size of 1.1 millimicron with a thickness of 0.12 millimicron) (0.81). The same couplers were present in this layer as in the slow magenta dye-forming layer: coupler M-X (0.23), coupler M-X1 (0.04), and coupler DIR-M (0.005). Gelatin was also added (1.08).

Yellow Filter Layer

This layer comprised Carey-Lea Silver (0.04) and an oxidized developer scavenger (0.05) with gelatin (0.86).

Slow Yellow Dye-forming Layer

This layer comprised a blend of (A) blue-sensitized, tabular grain silver bromoiodide emulsion (3 mole percent iodide) (grain size: 1.0 millimicron in diameter and 0.10 millimicron thick) (0.18) and (B) blue-sensitized, tabular grain silver bromoiodide emulsion (3 mole percent iodide) (grain size: 0.4 millimicron in diameter and 0.08 millimicron thick) (0.25). The yellow dye-forming coupler designated as Y-Z, as previously described, was incorporated in this layer (0.97). Gelatin was also added (1.6).

Fast Yellow Dye-forming Layer

This layer comprised a blue-sensitized, tabular grain silver bromoiodide emulsion (3 mole percent iodide) (grain size: 2.0 millimicron in diameter and 0.11 millimicron thick) (0.37). The yellow dye-forming coupler Y-Z was also incorporated in this layer (0.30). Gelatin was also added (0.81).

Overcoat

The resulting fast yellow dye-forming layer was overcoated with a gelatin layer (1.21).

The DIAR couplers as designated in following Table II were added to both the fast and slow yellow dye-forming layers. The concentration of the couplers in each layer was as designated in the following Table II.

The resulting film was imagewise exposed and processed as described in Example 1, with the exception that no 2B filter was used.

TABLE II

| Yellow Image Coupler | Yellow DIR Coupler | Blue Gamma | Green Gamma | Red Gamma | Blue/Green | Blue/Red |
|---|---|---|---|---|---|---|
| Y-Z | DIR-X | 0.92 | 0.58 | 0.55 | 1.59 | 1.70 |
| Y-Z | DIAR-Z | 1.04 | 0.54 | 0.58 | 1.93 | 1.79 |

The results were evaluated for interimage effects. Interimage effect onto the green-sensitive layer was evaluated by the ratio of the blue gamma to the green gamma and the interimage effect onto the red-sensitive layer was evaluated by the ratio of the blue gamma to the red gamma as long as the green or red gamma was adequately inhibited. The maximum ratio was provided by the preferred combination of coupler Y-Z with DIAR-Z.

The structures of the above designated couplers are as follows:

C-X
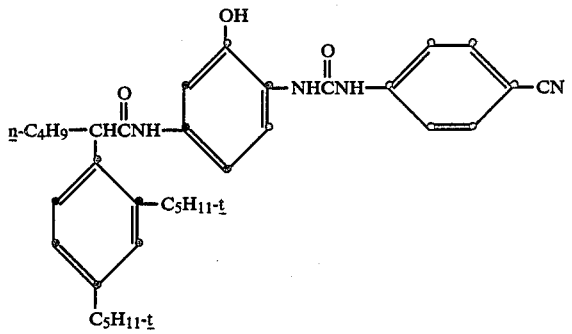
DIAR-C
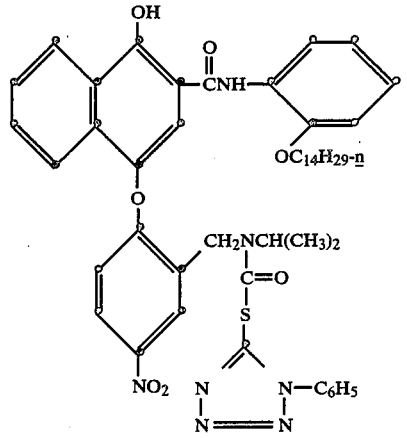
C-X1
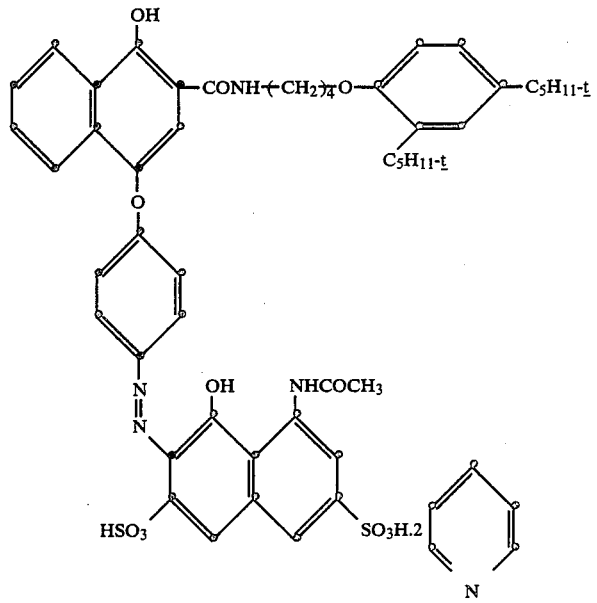
M-X
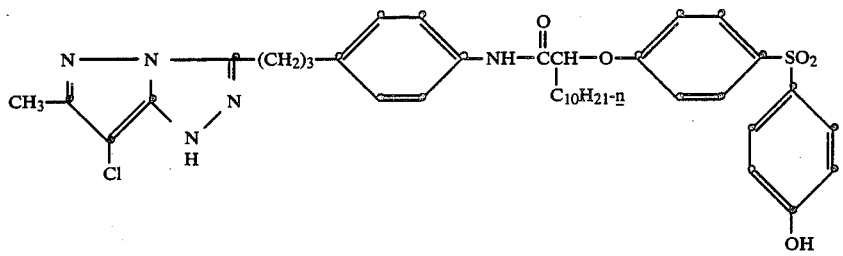

-continued
M-X1
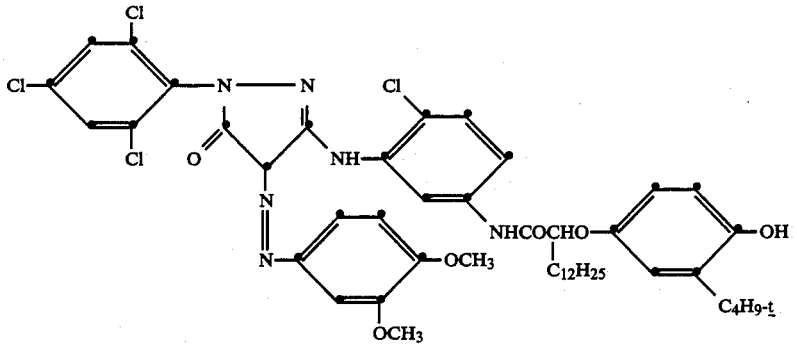
DIR-M
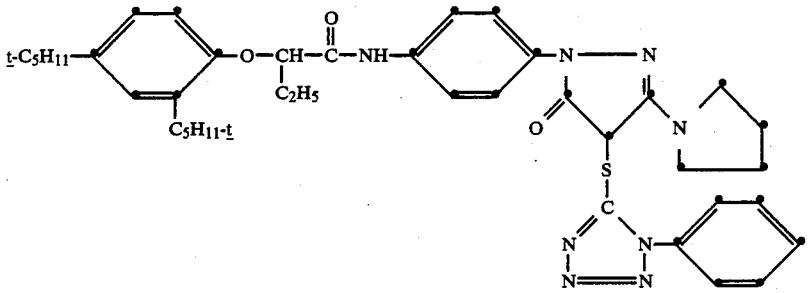
Y-X
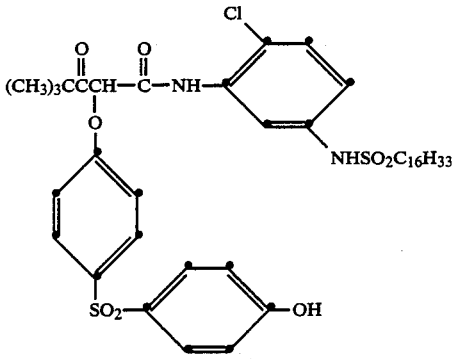
Y-Z
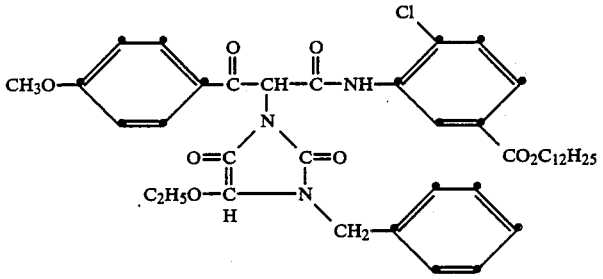
DIAR-Z
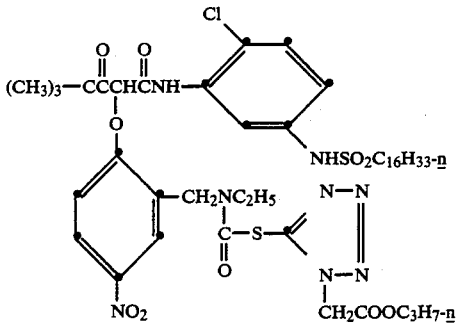

-continued

DIR-X

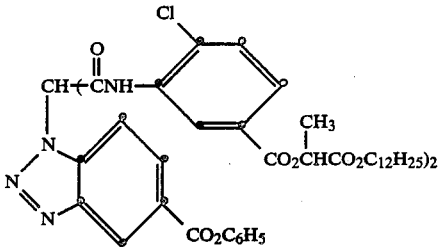

EXAMPLE 3

The photographic element as described in Example 2 was prepared with the exception that an interlayer was coated between the fast magenta dye-forming layer and the slow magenta dye-forming layer. This interlayer contained DIAR-Z (0.03) and MX-1 (0.04). The MX-1 was omitted from the fast magenta dye-forming layer.

The photographic element was exposed and processed as in Example 2 to provide similar results as in Example 2.

The invention has been described in detail with particular reference to preferred embodiments thereof, but it will be appreciated that variations and modifications can be effected within the spirit and scope of the invention.

What is claimed is:

1. A photographic element comprising a support bearing a silver halide emulsion layer, a photographic development inhibitor releasing coupler represented by the formula

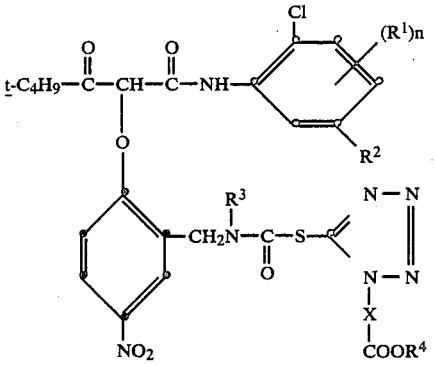

wherein $R^1$ is a substituent;

n is 0, 1 or 2;

$R^2$ is a ballast group;

$R^3$ is alkyl or aryl;

$R^4$ is alkyl containing 2 to 5 carbon atoms;

X is alkylene containing 1 to 3 carbon atoms; and a yellow dye-forming coupler represented by the formula:

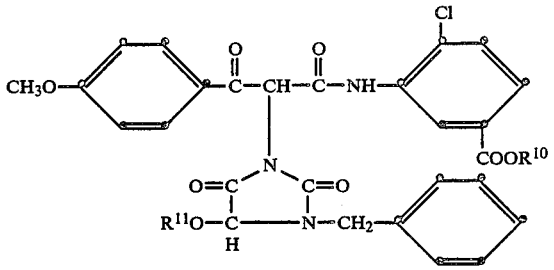

wherein $R^{10}$ is alkyl containing 8 to 32 carbon atoms; and $R^{11}$ is alkyl containing 2 to 4 carbon atoms.

2. A photographic element comprising a support bearing a silver halide emulsion layer, a photographic development inhibitor releasing coupler represented by the formula:

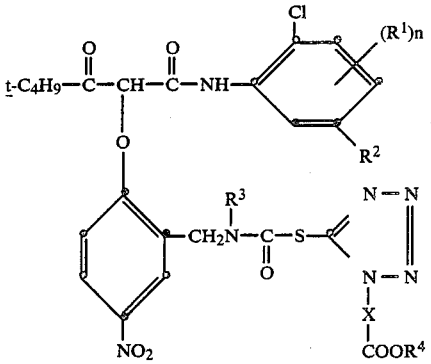

wherein $R^1$ is a substituent;

n is 0, 1 or 2;

$R^2$ is a ballast group;

$R^3$ is alkyl or aryl;

$R^4$ is alkyl containing 2 to 5 carbon atoms;

X is alkylene containing 1 to 3 carbon atoms; and a yellow dye-forming coupler represented by the formula:

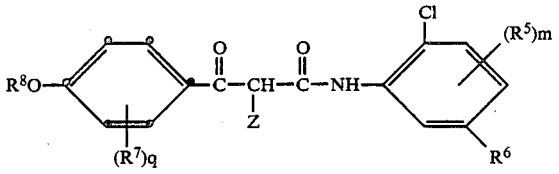

wherein $R^5$ and $R^7$ are individually substituted or unsubstituted alkyl, aryl, chloro, bromo or alkoxy;

m and q are individually 0, 1, or 2;

$R^6$ is a ballast group;

$R^8$ is unsubstituted or substituted alkyl;

Z is a coupling-off group that is

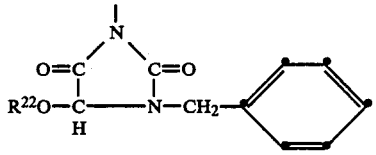

wherein $R^{22}$ is alkyl containing 2 to 4 carbon atoms.

3. A photographic element as in claim 1 wherein the yellow dye-forming coupler is represented by the formula:

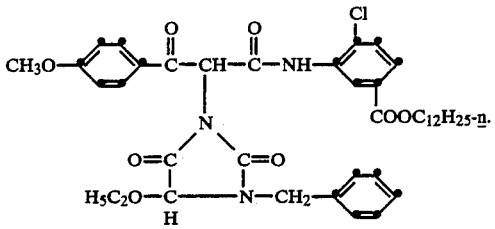

4. A photographic element as in claim 1 wherein the development inhibitor releasing coupler is represented by the formula:

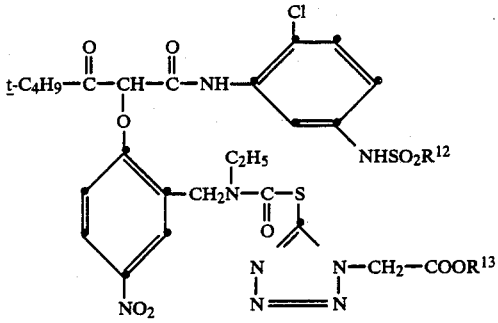

wherein $R^{12}$ is alkyl containing 8 to 32 carbon atoms; and, $R^{13}$ is alkyl containing 2 to 5 carbon atoms.

5. A photographic element as in claim 1 wherein the development inhibitor releasing coupler is represented by the formula:

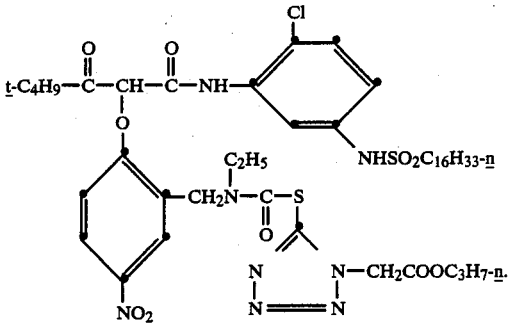

6. A photographic element as in claim 1 wherein the yellow dye-forming coupler is represented by the formula:

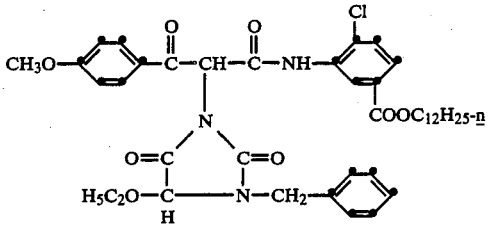

and the development inhibitor releasing coupler is represented by the formula:

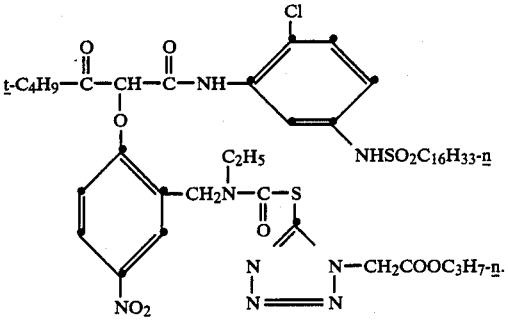

7. A photographic element comprising a support bearing at least one red-sensitive silver halide emulsion layer comprising a phenolic cyan dye-forming coupler having in the 5-position a ballast group comprising a sulfone group and in the 2-position a paracyanophenylureido group; at least one green-sensitive silver halide emulsion layer comprising a pyrazolo-[3,2-c]-s-triazole magenta dye-forming coupler comprising an alkyl group containing 1 to 4 carbon atoms in the 6-position, a ballast group in the 3-position having a terminal carboxy group and a coupling-off group in the 7-position; and at least one blue-sensitive silver halide emulsion layer comprising a yellow dye-forming coupler represented by the formula:

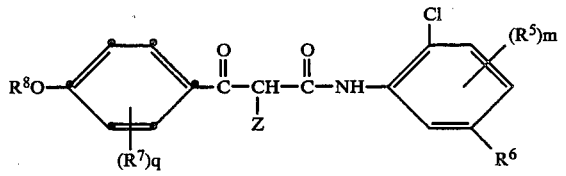

wherein $R^5$ and $R^7$ are individually substituted or unsubstituted alkyl, aryl, chloro, bromo, or alkoxy;

m and q are individually 0, 1, or 2;

$R^6$ is a ballast group;

$R^8$ is unsubstituted or substituted alkyl;

Z is a coupling-off group that is

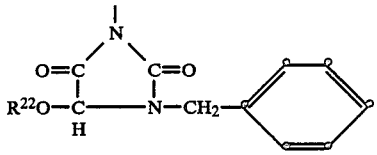

wherein $R^{22}$ alkyl containing 2 to 4 carbon atoms; and a photographic development inhibitor releasing coupler represented by the formula:

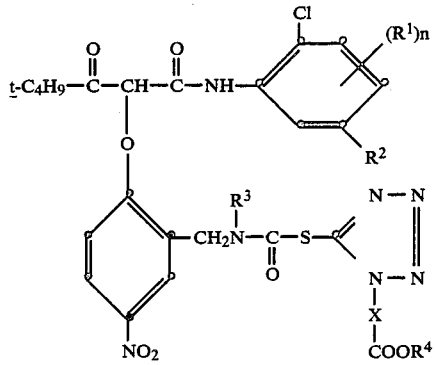

wherein $R^1$ is a substituent;

n is 0, 1 or 2;

$R^2$ is a ballast group;

$R^3$ is alkyl or aryl;

$R^4$ is alkyl containing 2 to 5 carbon atoms;

X is alkylene containing 1 to 3 carbon atoms.

8. A photographic element comprising a support bearing (a) a red-sensitive silver halide emulsion layer comprising a cyan dye-forming coupler represented by the formula:

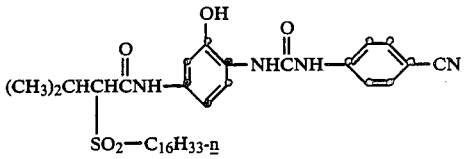

or

-continued

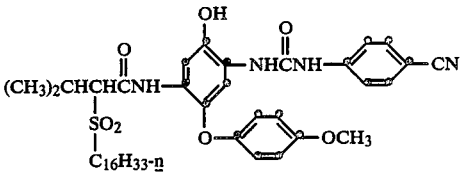

and a development inhibitor releasing coupler represented by the formula:

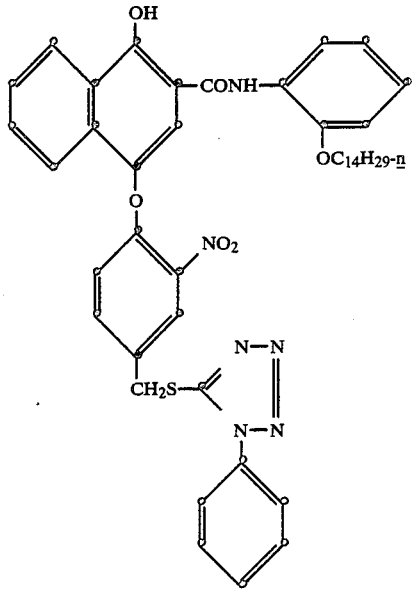

or

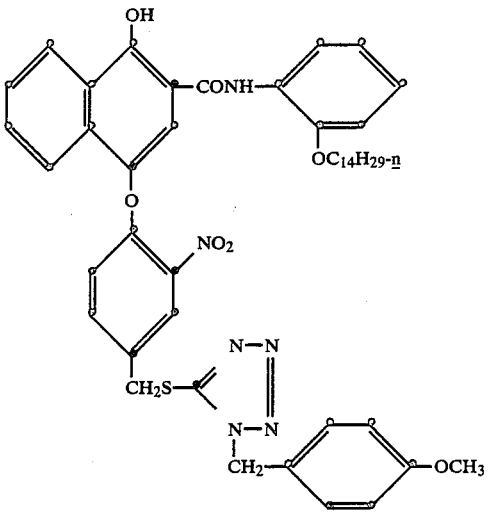

(b) a green-sensitive silver halide emulsion layer unit comprising at least two green-sensitive silver halide emulsion layers comprising a magenta dye-forming coupler represented by the formula:

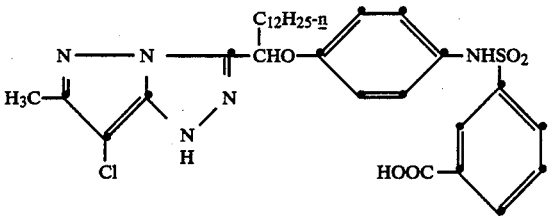

or

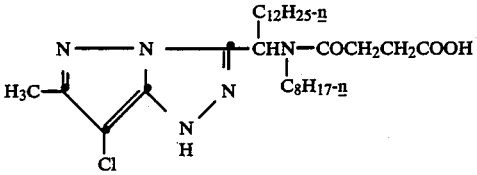

and at least one layer comprising a development inhibitor releasing coupler represented by the formula:

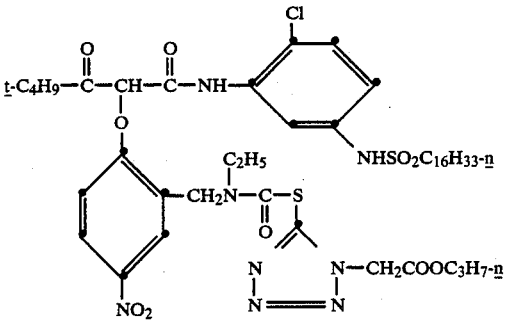

and (c) a blue-sensitive silver halide emulsion layer comprising a yellow dye-forming coupler represented by the formula:

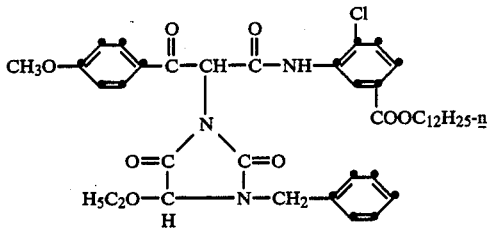

and a development inhibitor releasing coupler.

9. A process of forming a dye image in an exposed photographic element as defined in claim 2 said process comprising developing the exposed photographic element with a silver halide color developing agent.

10. A process of forming a dye image in an exposed photographic element comprising a support bearing a silver halide emulsion layer, a photographic development inhibitor represented by the formula:

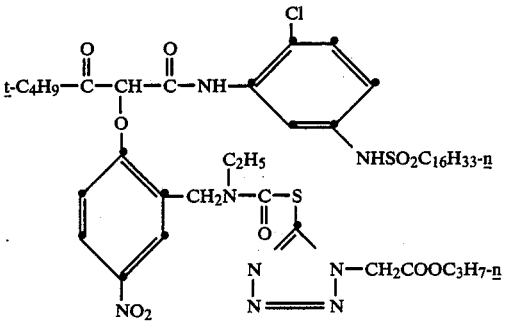

and a yellow dye-forming coupler represented by the formula:

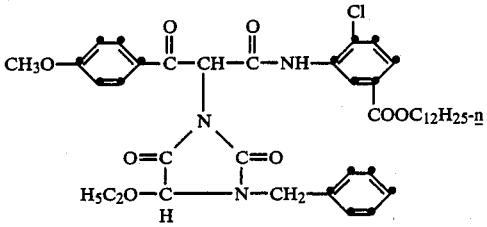

wherein the process comprises developing the photographic element with a silver halide color developing agent.

11. A process as in claim 10 wherein the silver halide color developing agent is a p-phenylenediamine.

12. A process of forming a dye image in an exposed photographic element as defined in claim 1 said process comprising developing the exposed photographic element with a silver halide color developing agent.

* * * * *

UNITED STATES PATENT AND TRADEMARK OFFICE

CERTIFICATE OF CORRECTION

PATENT NO. : 4,980,267

DATED : December 25, 1990

INVENTOR(S) : Terry R. Taber

It is certified that error appears in the above-identified patent and that said Letters Patent is hereby corrected as shown below:

Column 23, line 65, "and a" should begin a new paragraph at the left margin.

Column 24, line 56, "and a" should begin a new paragraph at the left margin.

Column 27, line 27, "$R^{22}$ alkyl" should read: --$R^{22}$ is alkyl--.

Signed and Sealed this

Twenty-first Day of September, 1993

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 4,980,267

DATED : December 25, 1990

INVENTOR(S) : Terry R. Taber

It is certified that error appears in the above-identified patent and that said Letters Patent is hereby corrected as shown below:

Column 21, Coupler YZ, the part of the formula reading:

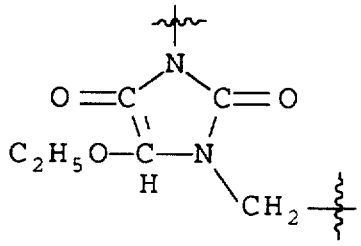

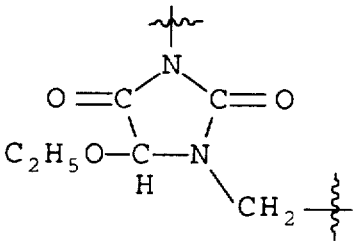

should read: